United States Patent [19]

Harlan

[11] 4,299,367

[45] Nov. 10, 1981

[54] SHELF BRACKET

[76] Inventor: F. Kellogg Harlan, 1617 Sprucewood, Rockford, Ill. 61107

[21] Appl. No.: 103,396

[22] Filed: Dec. 13, 1979

[51] Int. Cl.[3] ..... A47G 29/02

[52] U.S. Cl. ..... 248/235; 248/220.2; 248/224.4; 248/225.2

[58] Field of Search ..... 108/152; 248/220.2, 248/222.4, 224.4, 225.2, 235, 250

[56] References Cited

U.S. PATENT DOCUMENTS

| | | | |
|---|---|---|---|
| 479,424 | 7/1892 | Huff et al. | 248/235 |
| 541,114 | 6/1895 | Nolan | 248/235 |
| 2,471,459 | 5/1949 | Stich | 248/235 |
| 2,872,144 | 2/1959 | Hobson | 248/224.2 |
| 3,265,344 | 8/1966 | Ornstein | 248/243 |
| 3,381,636 | 5/1968 | Saiberlich | 248/225.2 X |
| 3,432,134 | 3/1969 | Forschmidt | 248/235 |
| 3,672,624 | 6/1972 | Keller | 248/243 |
| 4,051,789 | 10/1977 | Howitt | 248/243 X |
| 4,121,801 | 10/1978 | Kellogg | 248/235 |
| 4,165,852 | 8/1979 | Chervenak | 248/225.2 |

*Primary Examiner*—William H. Schultz

*Attorney, Agent, or Firm*—Vernon J. Pillote

[57] ABSTRACT

A shelf bracket assembly of the type including a shelf bracket formed of wood composition board and a mounting bracket formed of plastic. The shelf bracket has a rear notch at the upper rear corner and a forward notch extending downwardly and rearwardly from its upper surface. The mounting bracket is a one-piece plastic body open at the top and bottom and having spaced side members overlying the ends of the notches in the shelf bracket and a downwardly and rearwardly inclined tongue extending between the side members for reception in the forward notch and an upright wall extending between the rear ends of the side members for reception in the rear notch. The rear wall of the mounting bracket has an opening for receiving a headed fastener for attaching the shelf bracket assembly to a wall.

5 Claims, 5 Drawing Figures

Fig. 1.
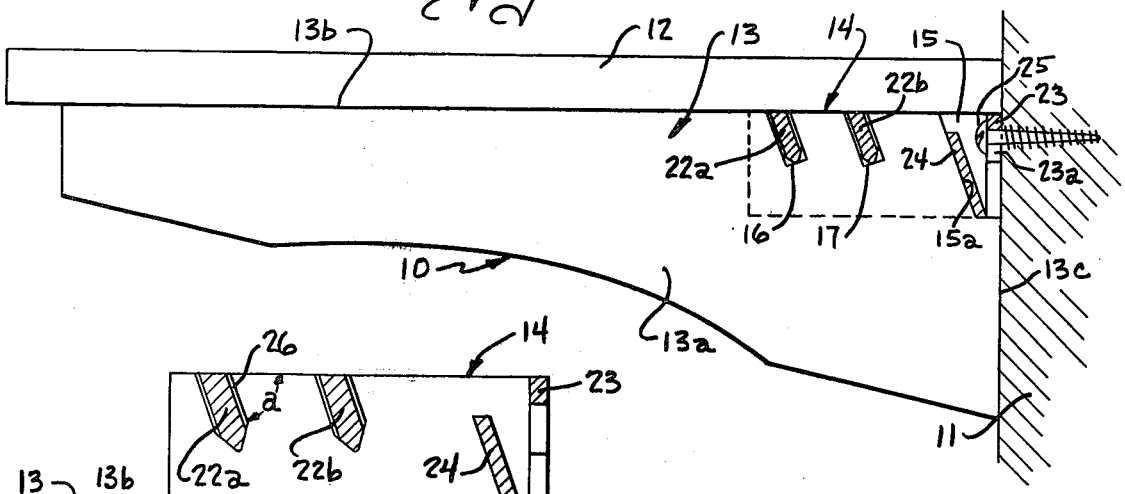
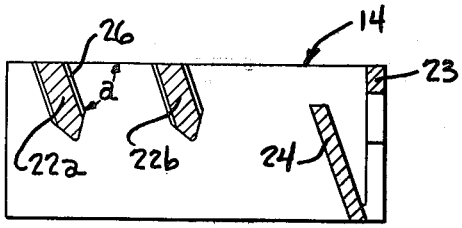
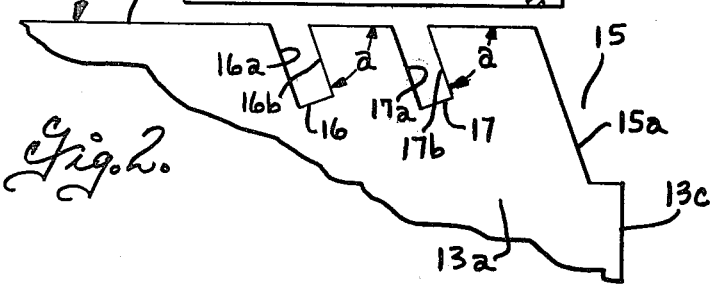
Fig. 2.
Fig. 5.
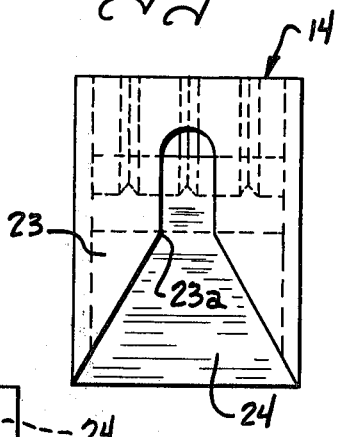
Fig. 3.
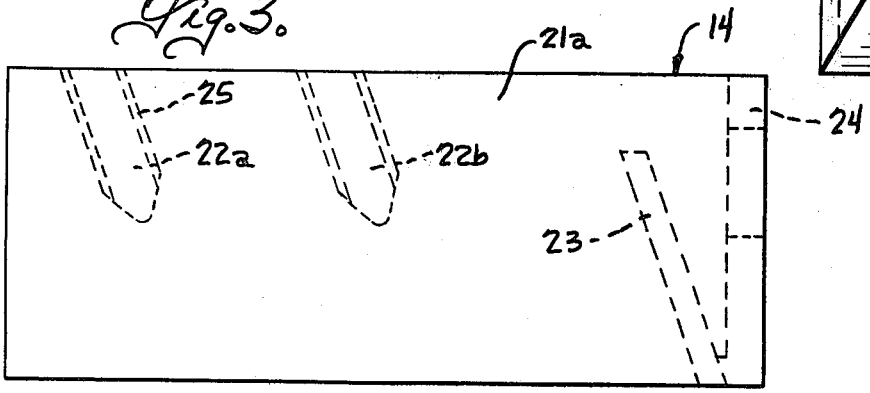
Fig. 4.
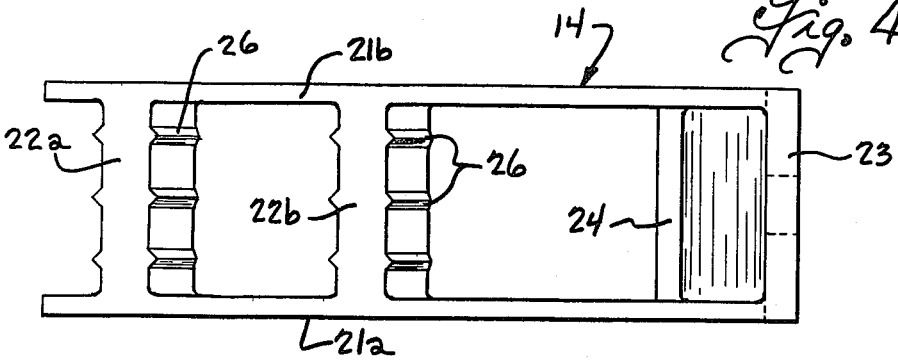

SHELF BRACKET

BACKGROUND OF THE INVENTION

Various different arrangements, for example as shown in U.S. Pat. Nos. 3,265,344; 3,432,134; 3,672,624 and in the applicant's prior U.S. Pat. No. 4,121,801, have been devised for mounting shelf brackets formed of wood composition board or wood so as to extend in cantilever fashion from an upright support. In general, the prior art devices assembled a metal mounting bracket on the shelf bracket and then mounted the metal mounting bracket on the upright support surface. Some of the prior devices, such as shown in U.S. Pat. Nos. 3,265,344 and 3,432,134 utilize screws to assemble the metal mounting bracket on the shelf bracket. In others, such as shown in U.S. Pat. No. 3,672,624, and in one embodiment of my prior U.S. Pat. No. 4,121,801, the metal mounting bracket can be assembled on the shelf bracket member without requiring the use of screws. However, forming of the shelf bracket to receive the metal mounting bracket in such prior devices was such as to require either several sequential woodworking operations on different machines or a releatively complex special machine that could perform several different woodworking operations on the shelf bracket at the same time.

SUMMARY OF THE INVENTION

It is an object of the present invention to provide a shelf bracket assembly of the type that includes a shelf bracket formed of composition board or wood and a mounting bracket, and which shelf bracket assembly has an improved arrangement for assembling the mounting bracket on the shelf bracket without the use of screws and in such a manner that all of the woodworking operations necessary to form the shelf bracket for receiving the mounting bracket can be performed on a simple single arbot woodworking machine and in a single operation.

Other objects of this invention are to provide a shelf bracket assembly in accordance with the foregoing object which is pleasing in appearance and capable of supporting relatively heavy shelf loads.

Accordingly, the present invention provides a shelf bracket assembly of the type including a shelf bracket formed of wood composition board or wood having a top shelf supporting surface and a rear abutment surface extending perpendicular to the shelf supporting surface, a rear notch at the upper rear corner defining a rear recessed surface above and offset forwardly from the rear abutment surface, and a forward notch extending downwardly from the top shelf supporting surface at a location forwardly of the rear recessed surface and defining a pair of spaced notched walls extending between the side faces of the shelf bracket, and a mounting bracket for attaching the shelf bracket to a supporting surface, characterized in that the pair of spaced notch walls in the shelf bracket are inclined downwardly and rearwardly from the top shelf supporting surface at a preselected acute angle and the mounting bracket comprises a one-piece plastic body open at the top and bottom and having spaced side members, a forward tongue member extending between the side members adjacent the forward end, and a rear wall member extending between the side members adjacent the rear end, the tongue member being inclined downwardly and rearwardly from the upper edge of the side members at said preselected acute angle and at a location therealong to engage the pair of spaced notch walls when the mounting bracket is assembled on the shelf bracket with the upper edges of the side members substantially coplanar with the top shelf supporting surface, and the rear wall member being disposed generally perpendicular to the upper edges of the side members to have its rear face substantially coplanar with the rear abutment surface when the mounting bracket is assembled on the shelf bracket, the rear wall having an opening therein for receiving a headed fastener to attach the shelf bracket assembly to a wall.

These, together with other objects and advantages of this invention will become apparent from the following description taken in connection with the accompanying drawings wherein:

FIG. 1 is a vertical sectional view through a shelf bracket assembly embodying the present invention;

FIG. 2 is a fragmentary exploded view illustrating assembly of the mounting bracket on the shelf bracket;

FIG. 3 is a side elevational view of mounting bracket;

FIG. 4 is a top plan view of the mounting bracket; and

FIG. 5 is a rear elevational view of the mounting bracket.

The shelf bracket assembly designated generally by the numeral 10 is adapted for attachment to an upright surface such as a wall 11 to extend therefrom in cantilever fashion for supporting a shelf 12. The shelf assembly includes a shelf bracket 13 formed of wood composition board or wood, and a mounting bracket 14 mounted on the shelf bracket 13 adjacent the upper rear corner thereof, for attaching the shelf bracket to the wall 11. The shelf bracket 13 has relatively parallel side faces 13*a*, a top shelf supporting surface 13*b* which extends generally horizontally, and a rear abutment surface 13*c* that extends perpendicular to the top shelf supporting surface and is located adjacent the lower rear corner of the shelf bracket member. The shelf bracket also has a rear notch 15 at the upper rear corner defining a rear recessed surface 15*a*, and at least one and preferably two notches 16 and 17 that extend downwardly from the top shelf supporting surface 13*b* at locations spaced forwardly from the rear recessed surface 15*a*. The notches 16 and 17 define spaced notch walls 16*a*, 16*b* and 17*a*, 17*b* respectively that extend between the side faces 13*a* of the shelf bracket member. For reasons pointed out hereinafter, notches 16 and 17 are inclined downwardly and rearwardly from the top shelf supporting surface at an included angle designated a of the order of 20° and the rear notch 15 is also formed so that the recessed surface 15*a* extends downwardly and rearwardly at the same included angle a, to thereby extend parallel to the notch walls 16*a* and 16*b* and 17*a* and 17*b*. Notches 16 and 17 extend to preselected depths for example $\frac{3}{4}$ of an inch, and the rear notch preferably extends to a somewhat greater depth, for example of the order of about 2". The mounting bracket 14 is preferably formed of a strong rigid plastic material such as high impact polystyrene, polycarbonates, etc., and comprises a one-piece plastic body open at the top and bottom and including spaced side members 21*a* and 21*b*, a forward tongue member 22*a* extending between the side members adjacent the forward end thereof and a rear wall member 23 extending between the side members adjacent the rear end thereof. An intermediate tongue member 22*b* can be provided between the side members at a location intermediate the ends thereof and a tie wall member 24 extends between the side members 21*a* and 21*b* adjacent the rear end thereof but forwardly of the rear wall member 23. The tongue members 22*a* and 22*b* are inclined downwardly and rearwardly from the upper edges of the side members 21*a* and 21*b* at the same preselected acute angle a as the notches 16 and 17, at a location therealong to be receivable in the respective notches 16 and 17 when the mounting bracket is assembled on the shelf bracket as shown in FIG. 1 with the upper edges of the side members substantially coplanar with the shelf supporting surface 13*b*. The rear wall member 23 on the mounting bracket is disposed generally perpendicular to the upper edges of the side members 21*a* and 21*b* to have its rear face substantially coplanar with the rear abutment surface 13*c* when the mounting bracket is assembled on the shelf bracket member. The rear wall member 23 has an opening 23*a* therein for receiving a heated fastener such as a screw or nail 25 that extends into the wall 11. As best shown in FIG. 5, opening 23*a* is in the form of a downwardly opening notch having a narrow upper end dimensioned to receive the shank of the fastener 25 but smaller than the head on the fastener, and an enlarged lower end to allow the head of the fastener to be moved laterally therethrough.

The fastener receiving opening 23*a* in the rear wall 23 substantially weakens the rear wall and the tie wall member 24 is provided to extend between the side members 21*a* and 21*b* of the mounting bracket adjacent the rear end thereof to rigidify the rear portion of the mounting bracket. The tie wall member 24 is advantageously inclined downwardly and rearwardly to extend alongside the rear recessed surface 15*a*. The tie wall member extends between the side wall 21*a* and 21*b* members at least adjacent the lower portion thereof and may terminate below the upper edge of the side wall members as shown in FIGS. 1 and 2. Side wall members 21*a* and 21*b* have a depth at least to substantially cover the ends of the notches 15–17 in the shelf bracket member. In the embodiment shown, the side wall members 21*a* and 21*b* have a uniform depth throughout their length corresponding to the depth of the rear notch. Since the notches 16 and 17 have a depth less than the depth of the rear notch 15, the side wall members 21*a* and 21*b* could be made somewhat shallower adjacent the forward end of the bracket and still cover the notches 16 and 17.

In order to facilitate assembly of the mounting bracket on the shelf bracket member, the tongues 22*a* and 22*b* have a nominal thickness slightly less than the width of the notches 16 and 17 so as to be receivable therein, and V-shaped ribs 26 are provided on opposite side faces of the tongues to extend therealong generally parallel to the side members 21*a* and 21*b*. The ribs 26 project from the face of the tongues a distance such that the thickness of the tongues measured across the ribs is somewhat greater than the width of the notches 16 and 17 whereby the tongues will become embedded in the walls of the notches, when the mounting bracket is pressed to position on the shelf bracket.

From the foregoing it is thought that the construction and use of the shelf bracket assembly will be readily understood. The notches 16, 17 and the rear recessed surface 15*a* in the shelf bracket are disposed at the same acute angle to the upper edge of the shelf bracket member so that notches 15, 16, 17 can be formed by spaced saw or cutter blades mounted on a single arbor, and in a single operation. This markedly simplifies and expedites forming of the shelf bracket. The mounting bracket can be formed in a single molding operation with rather simple mold. The mounting bracket is assembled on the shelf bracket by merely pressing the mounting bracket onto the shelf bracket as shown in FIG. 2 and, when assembled, the upper edge of the mounting bracket is disposed coplanar with the upper shelf supporting surface 13*b* on the shelf bracket and the rear wall member 23 of the mounting bracket is disposed substantially coplanar with the rear abutment surface 13*c* on the shelf bracket. Thus, the mounting bracket underlies and directly supports the rear portion of the shelf 12 when it is assembled on the shelf bracket. In addition, the tongues 23*a* and 23*b* on the mounting bracket take up the tension forces that occur during loading of the shelf bracket and, by reason of the downward and rearward inclination of the tongues, any tendency of the shelf bracket to slip downwardly relative to the mounting bracket will merely force the rear abutment surface 13*c* on the shelf bracket more firmly against the wall 11. When the mounting bracket is assembled on the shelf bracket, the side members 21*a* and 21*b* cover the ends of the rear notch 15 and the forward and intermediate notches 16, 17 to provide a pleasing appearance.

The embodiments of the invention in which an exclusive property or privilege is claimed are defined as follows:

1. A shelf bracket assembly adapted for mounting at the rear end thereof on an upright supporting surface, the shelf bracket assembly including an elongated shelf bracket formed of particle board or wood having spaced side faces and a top shelf supporting surface and a rear abutment surface disposed in a plane perpendicular to the top shelf supporting surface, the shelf bracket member also having a rear notch at the upper rear corner thereof defining a rear recessed surface extending between the spaced side faces and disposed above and offset forwardly from said rear abutment surface, and a forward notch extending downwardly from the top shelf supporting surface at a location forwardly of the rear recessed surface and defining a pair of spaced notch walls extending between the side faces, and a mounting bracket for attaching the shelf bracket to a supporting surface, characterized in that said pair of spaced notch walls are inclined downwardly and rearwardly from said top shelf supporting surface at a preselected acute angle, said mounting bracket comprising a one-piece plastic body open at the top and bottom thereof and including spaced side members and a forward tongue member extending between the side members adjacent the forward end thereof and a rear wall member extending between the side members adjacent the rear end thereof, the tongue member being inclined downwardly and rearwardly from the upper edge of the side members at said preselected acute angle at a location therealong to engage the pair of spaced notch walls when the mounting bracket is assembled on the shelf bracket with the upper edges of the side members substantially coplanar with top shelf supporting surface, the rear wall member being disposed generally perpendicular to the upper edges of side members to have its rear face substantially coplanar with said rear abutment surface when mounting bracket is assembled on the shelf bracket, said rear wall member having an opening therein for receiving a headed fastener to attach the shelf assembly to an upright supporting surface.

2. A shelf bracket assembly according to claim 1 wherein said rear recessed surface is inclined downwardly and rearwardly from said top shelf supporting surface at said preselected acute angle, said mounting bracket including a tie wall member extending between the side members forwardly of said rear wall member and inclined downwardly and rearwardly at said preselected acute angle to extend alongside said rear recessed surface when the mounting bracket is in said assembled position on the shelf bracket.

3. A shelf bracket assembly according to claim 2 wherein said shelf bracket has an intermediate notch inclined downwardly and rearwardly at said preselected acute angle from said top shelf supporting surface at a location intermediate said forward and rear notches, and said mounting bracket has an intermediate tongue member inclined downwardly and rearwardly at said preselected acute angle from the upper edge thereof at a location rearwardly of said forward tongue member to extend into said intermediate notch when the mounting bracket is in said assembled position on the shelf bracket.

4. A shelf attaching bracket according to claim 1 wherein said shelf bracket has an intermediate notch inclined downwardly and rearwardly at said preselected acute angle from said top shelf supporting surface at a location intermediate said forward and rear notches, and said mounting bracket has an intermediate tongue member inclined downwardly and rearwardly at said preselected acute angle from the upper edge thereof at a location rearwardly of said forward tongue member to extend into said intermediate notch when the mounting bracket is in said assembled position on the shelf bracket.

5. A shelf bracket assembly according to claim 1 wherein said forward tongue member has protrusions on at least one face thereof, the thickness of the tongue member measured at locations offset from the protrusions being less than the spacing between the pair of notch walls and the thickness of the tongue member measured at the protrusions being sufficiently greater than the spacing between the pair of notch walls to form a press fit therewith.

* * * * *